US008272978B2

(12) United States Patent
Windsor

(10) Patent No.: US 8,272,978 B2
(45) Date of Patent: Sep. 25, 2012

(54) BATTING TRAINING AID

(76) Inventor: Steven T. Windsor, Spring, TX (US)

( * ) Notice: Subject to any disclaimer, the term of this patent is extended or adjusted under 35 U.S.C. 154(b) by 0 days.

(21) Appl. No.: 12/492,669

(22) Filed: Jun. 26, 2009

(65) Prior Publication Data

US 2009/0325737 A1 Dec. 31, 2009

Related U.S. Application Data

(60) Provisional application No. 61/076,307, filed on Jun. 27, 2008.

(51) Int. Cl.
*A63B 69/00* (2006.01)

(52) U.S. Cl. ..... 473/457; 473/422

(58) Field of Classification Search ..... 473/422, 473/457, 519, 526, 549, 552, 559, 564, 568; D21/725–731

See application file for complete search history.

(56) References Cited

U.S. PATENT DOCUMENTS

| | | | | | |
|---|---|---|---|---|---|
| 335,656 | A | * | 2/1886 | Taylor | 473/526 |
| 703,911 | A | * | 7/1902 | Girdwood | 473/526 |
| 2,147,110 | A | * | 2/1939 | Schmid | 473/526 |
| D164,883 | S | * | 10/1951 | Schmid | D21/731 |
| 3,246,894 | A | * | 4/1966 | Salisbury | 473/457 |
| 3,353,824 | A | | 11/1967 | Hamson, Jr. | |
| 3,767,249 | A | * | 10/1973 | Rogers | 294/49 |
| 3,880,423 | A | * | 4/1975 | Kreag | 473/566 |
| 4,155,550 | A | * | 5/1979 | Planakis | 473/526 |
| 4,221,383 | A | * | 9/1980 | Cappelli | 473/526 |
| 4,461,043 | A | | 7/1984 | Lomedico | |
| 4,940,230 | A | | 7/1990 | Jian | |
| 4,943,058 | A | * | 7/1990 | Carbonetti | 473/551 |
| 5,135,226 | A | | 8/1992 | Place | |
| 5,169,145 | A | * | 12/1992 | Jang | 473/552 |
| 5,269,511 | A | * | 12/1993 | Chavez | 473/457 |
| 5,312,101 | A | * | 5/1994 | McDaniel | 473/526 |
| 5,322,286 | A | | 6/1994 | Frost | |
| 5,348,303 | A | | 9/1994 | Swissheim | |
| D362,704 | S | * | 9/1995 | Lee | D21/729 |
| 5,480,146 | A | | 1/1996 | Comer | |
| 5,588,651 | A | | 12/1996 | Frost | |
| 5,816,958 | A | * | 10/1998 | Seymour | 473/526 |
| 5,954,591 | A | | 9/1999 | Liberatore | |
| 6,305,051 | B1 | | 10/2001 | Cho | |
| 6,540,621 | B1 | | 4/2003 | Robinson | |
| 7,041,017 | B1 | | 5/2006 | Carfo | |
| 7,048,637 | B2 | | 5/2006 | McDonald | |
| 7,081,053 | B2 | | 7/2006 | Kallassy | |
| 7,125,353 | B2 | | 10/2006 | Blount | |
| 7,178,428 | B2 | | 2/2007 | Schroder | |
| 7,207,894 | B2 | | 4/2007 | Pine | |
| 2007/0243941 | A1 | | 10/2007 | Pine | |

* cited by examiner

*Primary Examiner* — Mitra Aryanpour
(74) *Attorney, Agent, or Firm* — Bushman & Associates, P.C.

(57) ABSTRACT

A training aid to teach batters a better swing, particularly the proper hand path of such a swing. The training aid has a head portion with at least one planar or flat surface to strike a practice ball, a neck portion having a first shorter run and a second longer run, the first and second runs being at an angle to one another, and a handle portion. The shorter run of the neck portion is connected to the handle portion while the longer run of the neck portion is connected to the head portion.

17 Claims, 7 Drawing Sheets

27
34
28
32
16
14
10
20
18
12
7
13
26
4
L
24
5
22
23
10

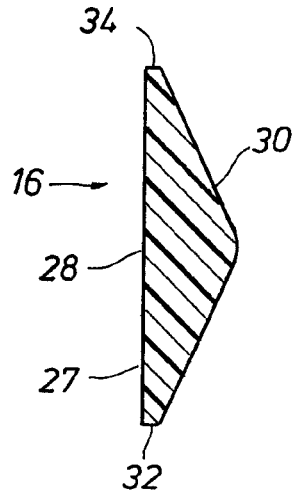
FIG. 4
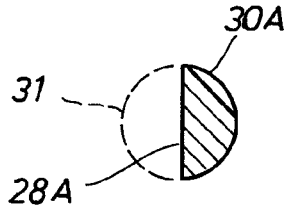
FIG. 4A
FIG. 5
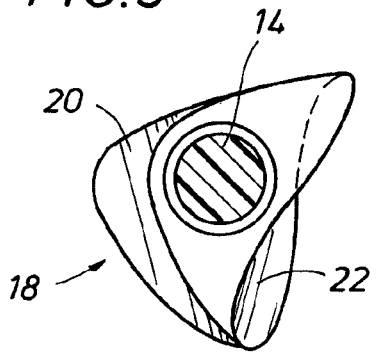
FIG. 6
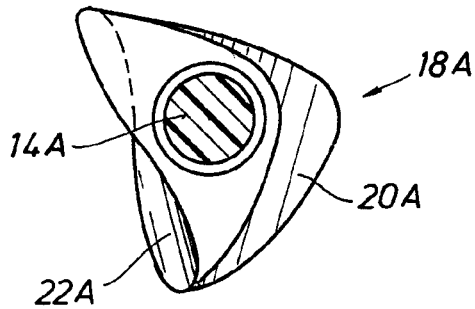
FIG. 7
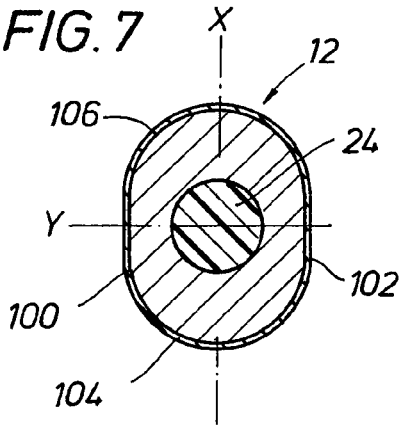
FIG. 8
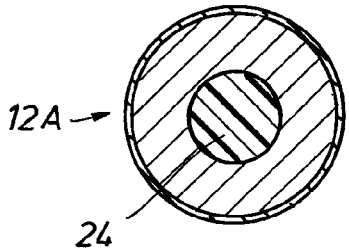

FIG.17
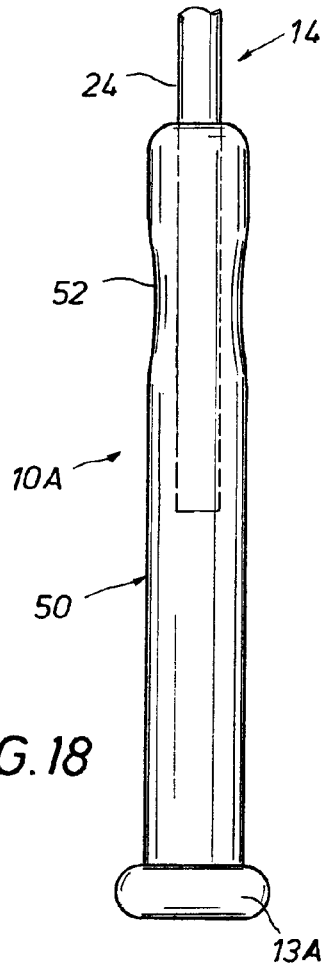
FIG.18
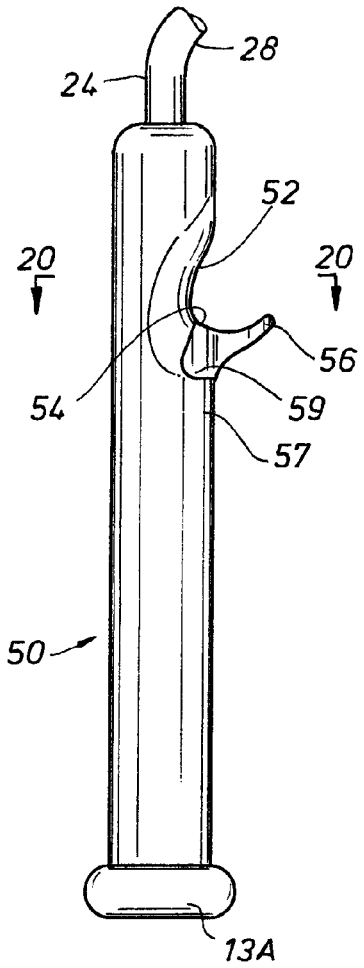
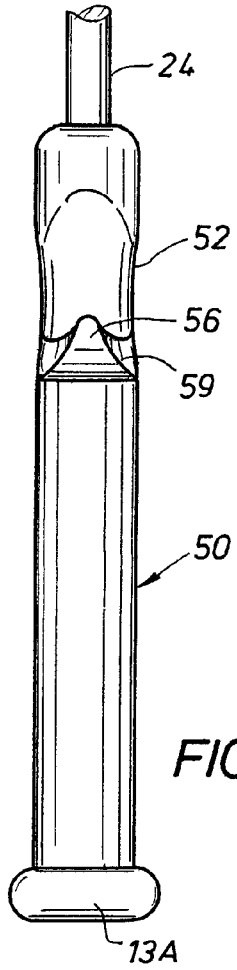
FIG.19
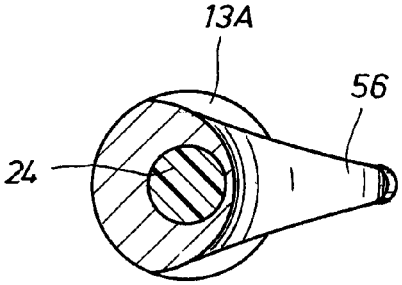
FIG.20
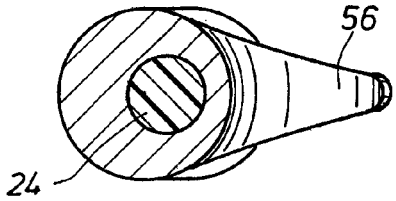
FIG.21

FIG. 22
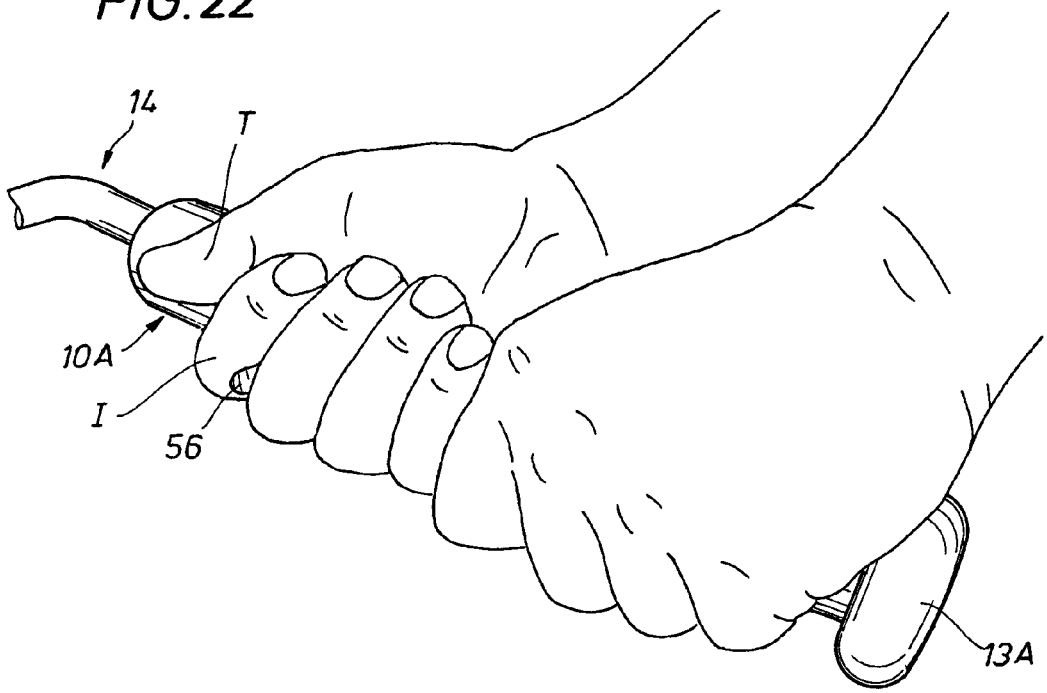
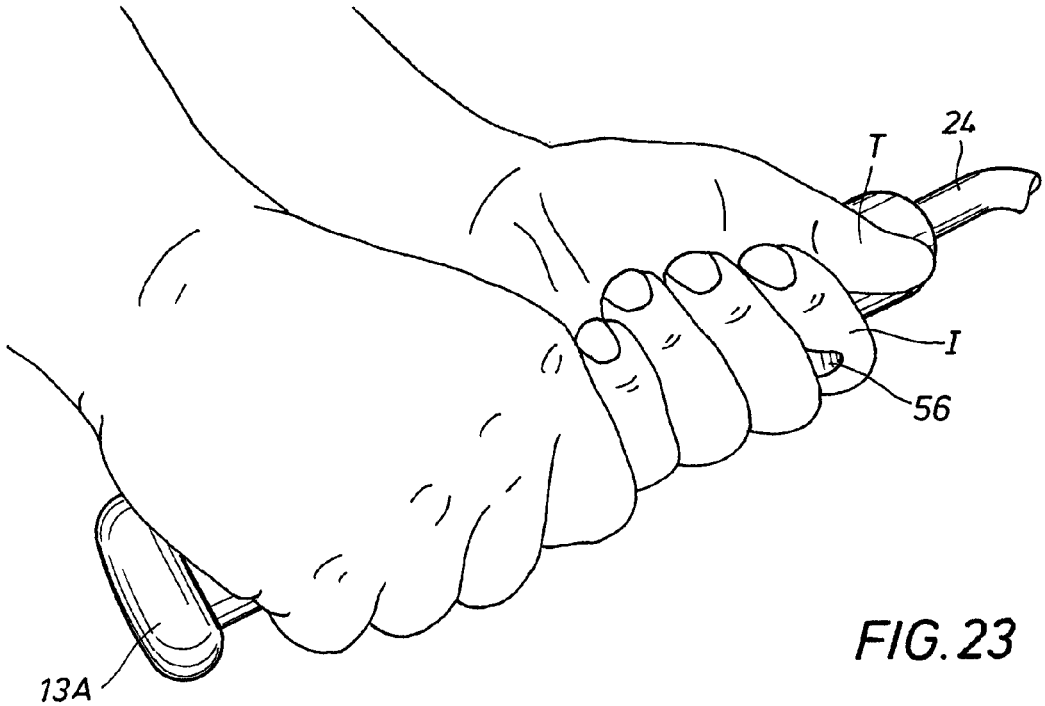
FIG. 23

BATTING TRAINING AID

CROSS-REFERENCE TO RELATED APPLICATION

This application claims the priority of U.S. Provisional Application No. 61/076,307 filed on Jun. 27, 2008, the disclosure of which is incorporated herein by reference for all purposes.

FIELD OF THE INVENTION

The present invention relates to a baseball/softball training aid and, in particular, to a training aid which helps instruct batters in the proper method of swinging a bat.

DESCRIPTION OF PRIOR ART

It is generally agreed by baseball coaches, particularly batting coaches, that proper hand path is an important element in the ability of a batter to hit the ball properly. Therefore, novice batters such as youngsters playing little league ball are usually instructed to develop proper hand path as a means of improving their hitting. Unfortunately, this is easier said than done, since the batter usually experiences difficulty in determining whether or not his or her hands and arms are moving in the proper path without the assistance of a coach appraising the swing. Continuous practice is required to develop the proper hand path and it is impractical for the major portion of the practice to be conducted in the presence of a coach. Thus, advantages are to be gained when the batter himself can ascertain the proper hand path of his/her swing during private practice sessions.

BRIEF DESCRIPTION OF THE DRAWINGS

FIG. 4 is a cross-sectional view taken along the lines 4-4 of FIG. 1.

FIG. 4A is a cross-sectional view similar to FIG. 4 of another head portion of the batting aid of the present invention.

FIG. 5 is a cross-sectional view taken along the lines 5-5 of FIG. 1.

FIG. 6 is a view similar to FIG. 5 but showing a left hand grip.

FIG. 7 is a cross-sectional view taken along the lines 7-7 of FIG. 2.

FIG. 8 is a view similar to FIG. 7 but showing an embodiment of the training aid of the present invention wherein the handle is substantially circular when viewed in transverse cross-section.

FIGS. 17-21 show another embodiment of the training aid of the present invention.

FIGS. 22 and 23 are isometric views showing the training aid of FIGS. 17-21 being gripped by a user.

SUMMARY OF THE INVENTION

In one aspect the present invention is directed to a training aid for teaching batters how to swing properly, the training aid having a handle portion, a neck or shank portion having a first run and a second run, the first run being shorter than the second run, the first run being attached to and generally coaxial with the handle portion, the second run being at an angle of at least about 5° to the first run, and a head, blade, paddle or striking portion having at least one substantially planar surface, the head, blade, paddle or striking portion being attached to the long run of the neck or shank portion.

DESCRIPTION OF THE PREFERRED EMBODIMENTS

Figures 1, 2, 3:
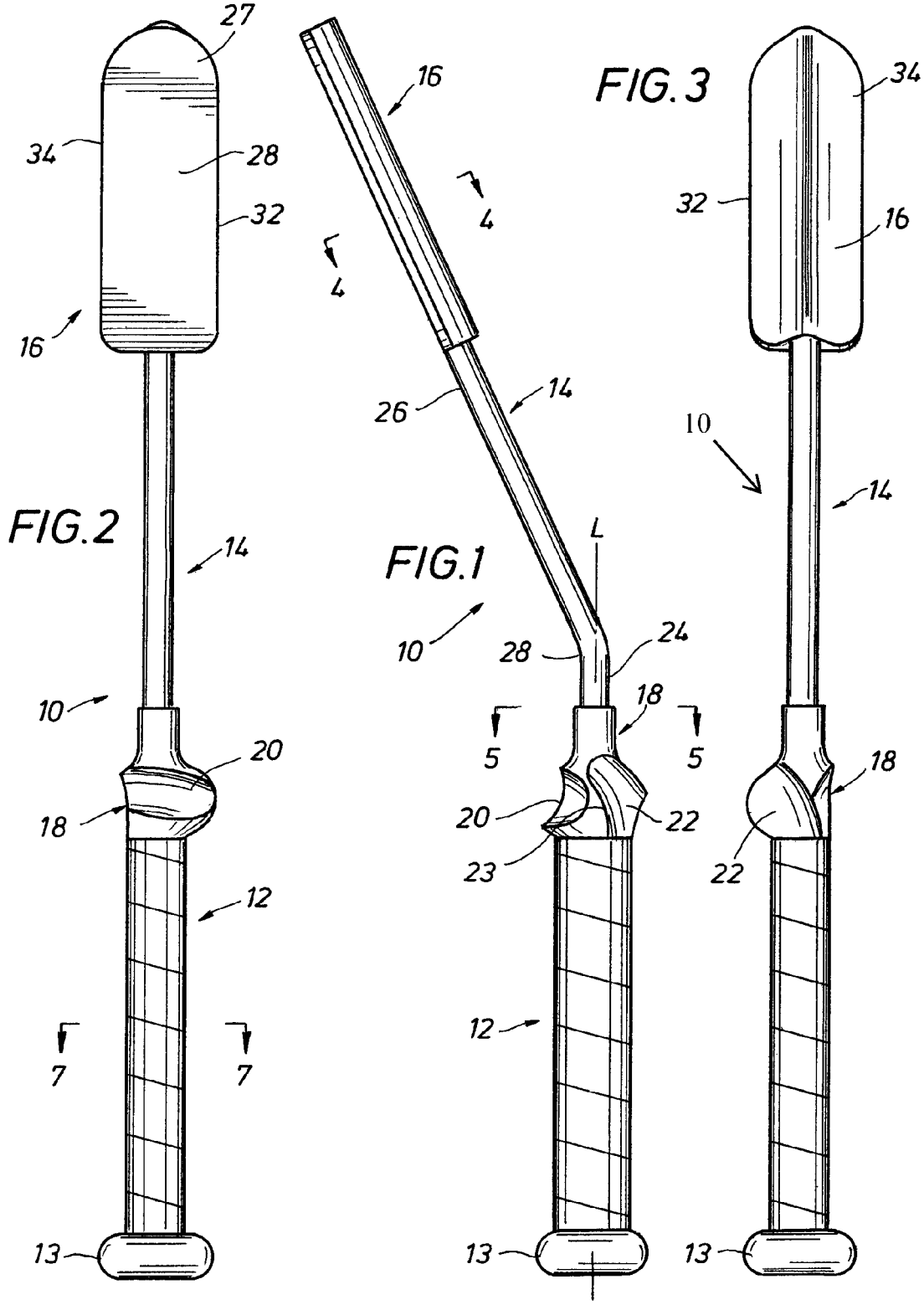
FIG. 1 is a side, elevational view of one embodiment of the training aid of the present invention.
FIG. 2 is a front, elevational view of the training aid shown in FIG. 1.
FIG. 3 is a rear, elevational view of the training aid shown in FIG. 1.

Referring first to FIGS. 1, 2 and 3, one embodiment of the training device of the present invention is shown in side, front and rear elevations, respectively. The batting training aid, shown generally as 10 comprises a handle portion 12, a neck, shank or shaft portion 14 and a head, blade or paddle portion 16. The handle portion 12 can include a grip portion 18 having contoured channels or receiving formations 20 and 22 for receiving and positioning the thumb and index finger of the user. The handle portion 12 terminates in a butt portion 13 which helps to prevent the batting aid 10 from slipping out of the user's hands in use.

The neck portion 14 which generally will comprise a metal or engineered plastic material has a first, shorter run 24 and a second, longer run 26, runs 24 and 26 being connected by an angled portion 28. The angle between the first and second runs can vary, generally being from about 5° to about 45°, more preferably from about 15° to about 40°, especially from about 20° to about 35°. The angle is measured between an imaginary line passing axially through the shorter run and an imaginary line passing axially through the longer run, the first and second runs being substantially straight. Shorter run 24 of neck or shank portion 14 is connected to handle 12 distal angled portion 28 while longer run 26 is connected to head or blade portion 16 distal angled portion 28. It will be understood that handle portion 12 can be secured to neck portion 14 by numerous methods. For example, neck portion 14 can include a section (not shown) which is received in an axially extending bore in handle portion 12 and pinned or otherwise securely attached to handle portion 12, e.g., by adhesive. Furthermore, the handle portion 12 could be molded around a section of run 24 of shank portion 14. As a practical matter, handle portion 12 can be attached to a section of run 24 of neck portion 14 by any suitable means or method. As can be seen with reference to FIGS. 1-3 shorter run 24 of neck portion 14 and head portion 12 are coaxial with respect to an axis extending lengthwise of handle 12 and lengthwise of run 24, the axis through handle 12 being indicated by the dotted line L.

Head portion 16 has a first side 27 which has a substantially flat or planar surface 28 while second side 30, in the embodiment shown, has a contoured surface which could be of various shapes. Blade portion 16 also includes a first side edge 32 and a second side edge 34, a cross-section through blade portion 16 being shown in FIG. 4. Planar surface will usually have a length in excess of its width making it generally elongate. It will be understood that blade portion 16 can take many shapes and configurations. In the embodiment shown in FIG. 4 it is generally triangular when viewed in transverse cross-section. It will be understood that the primary requirement vis-à-vis the shape of head portion 16 is that it have a substantially planar front or flat ball striking surface 28 regardless of the shape of the sides and/or the opposite or backside. In one embodiment, head portion 16 could be configured like part of a barrel of a conventional baseball or softball bat with the proviso that it have a substantially planar front or striking surface such as surface 28. Such a configuration is shown in FIG. 4A which represents a cross-section through the head portion of the bat wherein a barrel-like portion of a typical baseball or softball bat which has been cut through lengthwise to remove a portion of a cylinder or frustocone defining the barrel. Thus, there is formed a substantially planar, front or striking surface 28A, the remainder of the barrel portion being substantially solid as shown with a radiused backside surface 30A. The portion removed is indicated as 31 in dotted lines. When the head portion is substantially like the barrel portion of a conventional bat, albeit with a flat or planar striking surface, the sides and/or the back side of the barrel, instead of being substantially frustoconical may be of a shape such that if the training aid is used improperly, i.e., such that if the flat striking surface does not engage the practice ball, the ball when struck will not move in the desired trajectory but will either be forced downward into the ground or "popped up" or some other vertical trajectory other than essentially a line drive or a similar trajectory. However, it will be understood that the head portion could be as shown in FIG. 4A since in the majority of cases if the training aid is not swung properly, the planar surface 28 will not be engaged properly and the trajectory of the ball will not be as desired. Additionally, when the cross-section is as shown in FIG. 4A there is sufficient mass in the head portion to allow a real baseball or softball to be used as the practice ball.

Head portion 16 could be substantially planar or flat on both oppositely facing surfaces and a section of blade portion 16 forming an extension of run 26 molded or otherwise secured to the substantially flat or back surface. It will also be understood that head portion 16, while shown as being of plastic construction, is preferably of metallic construction. However, it could be of an engineered plastic, wood etc. and could be molded onto and/or formed as a part of run 26 of neck portion 14, particularly if neck portion 14 were made of an engineered plastic. In any event, whatever its construction, head portion 16 will be securely attached to neck portion 14 to prevent any relative rotation between neck portion 14 and head portion 16. Further, as will also be understood by those skilled in the art handle portion 12 will be affixed to neck portion 14 so as to prevent any relative rotation between those two portions, the goal being that none of the head, neck, or handle portions can rotate relative to any other portion.

Turning now to FIGS. 5 and 6, there is shown, in greater detail, one embodiment of the gripping portion 18 of the handle portion 12. Grip portion 18 includes a first contoured or receiving formation 20 for receiving the index finger of a user and a second contoured or receiving formation 22 for receiving the thumb of the user. While FIG. 5 shows index finger receiving formation 20 and thumb receiving formation 22 for a right-handed user, FIG. 6 is substantially a mirror image of FIG. 5 and shows a grip portion 18A that would be used in the case of a left-handed user.

Grip portion 18 can be formed monolithic with handle portion 12 or formed separately, in either event both portions being affixed or secured to a section of neck portion 14. In one form of construction, as shown more clearly with respect to FIG. 17, a trigger 56 is formed monolithically with a handle portion 59 with an axial bore in which in turn is received a section of run 24, e.g., the shorter run (shown in phantom in FIG. 18), and pinned or otherwise secured thereto. Thus there is an axially extending bore in the handle portion 59 into which a section of the shorter run extends and is secured thereto. There is a covering sheath 57 over handle portion 59 which can be made of a heat shrink type of plastic which is generally softer than the material of than the material of trigger portion 56 or handle portion 59 for more comfort when the handle 50 is gripped. However, it will be understood that such a construction is not necessary and that the handle including the grip portion could be molded into a monolithic piece. Additionally, the handle including a trigger or other such formation if desired could be formed monolithically, e.g., by molding of plastic, rubber, etc. and then a tape or the like wrapped around the molded handle to provide greater comfort or gripping ability if desired. Grip portion 18 and/or handle portion 12 can be formed from virtually any material but can conveniently be formed from a rubber or plastic material. In this regard, grip portion 18 or 18A can be formed from natural rubber, synthetic rubber and compound materials. Additionally, polymers such as EPDM (ethylene propylene diene monomer) can be used to form grip portion 18 and/or handle portion 12. As noted, grip portion and handle portion can be integrally formed, e.g., a monolithic structure, or can be formed separately and joined. Regardless of the construction, type of material employed, etc., it is also important, as noted, that grip portion 18 and handle portion 12 undergo no relative rotation to each other, to neck portion 14 or to head portion 16.

FIGS. 5 and 6 are cross-sectional views showing the various contoured formations that can be employed in forming the grip portion 18 while FIG. 7 is a cross-section through handle 12 showing that handle 12 is substantially oval or racetrack shaped when viewed in transverse cross-section. As shown in FIGS. 5 and 6, grip portion 18 can include a contoured or receiving portion 20 for receipt of the index finger of the user and a contoured or receiving portion 22 for receipt of the thumb of the user. However, it will be appreciated that in different embodiments, the grip portion 18 need only have an index finger receiving portion such as 20 or form a protruding trigger formation to position the index finger relative to batting aid 10 such that the index finger is restrained from any substantial axial movement along the axis of the handle portion 12. In still yet other embodiments of the training aid of the present invention, the receiving, protruding trigger formations can be dispensed with in lieu of a handle portion which is substantially uniform along its length, especially as discussed more fully hereafter, wherein the handle has a cross-sectional configuration of that shown in FIG. 7. In this simplified form of the training aid of the present invention, the provision of the two angled portions of the neck or shank portion, the shorter run of the neck or shank portion being coaxial with the long axis to the handle, the longer run of the neck portion being at an angle to that axis, the benefits of the present invention are achieved. Accordingly, it is not necessary that there be any receiving portion or trigger or the like. In general, when a receiving formation 20 in combination with a handle portion 12 having an oval cross-section as shown in FIG. 7 is used, once the index finger of the user is positioned into the receiving formation 20, the other fingers and thumb of that hand will almost automatically position themselves on the handle portion 12 in the proper manner. Further, especially when an oval or racetrack shape of the handle is used, as shown in FIG. 7, in combination with an index finger receiving formation 20, the handle portion 12 is oriented such that when the other hand is placed on the handle 12, the handle portion 12 distal the gripping portion 18 will be cradled in the other hand. Indeed, attempts of the user to position the other hand in any other fashion on the handle 12 other than when it is cradled in the natural channel formed when the fingers and thumb of the other hand are closed about the handle portion 12 will be uncomfortable to the user. Accordingly, once the index finger of the hand is positioned in the index finger receiving formation or on the trigger, positioning of the other fingers and thumb of that hand plus the position of the other hand on the handle is almost fool-proof.

FIG. 8 shows an alternative handle configuration 12A wherein the handle portion 12A is essentially circular when viewed in transverse cross-section as opposed to the preferred oval or racetrack shaped (viewed in transverse cross-section) formation shown in FIG. 7. However, while less desirable in terms of almost automatically positioning both hands of the user on the handle portion, a handle portion such as 12A which is circular in transverse cross-section will also function.

Figure 9:
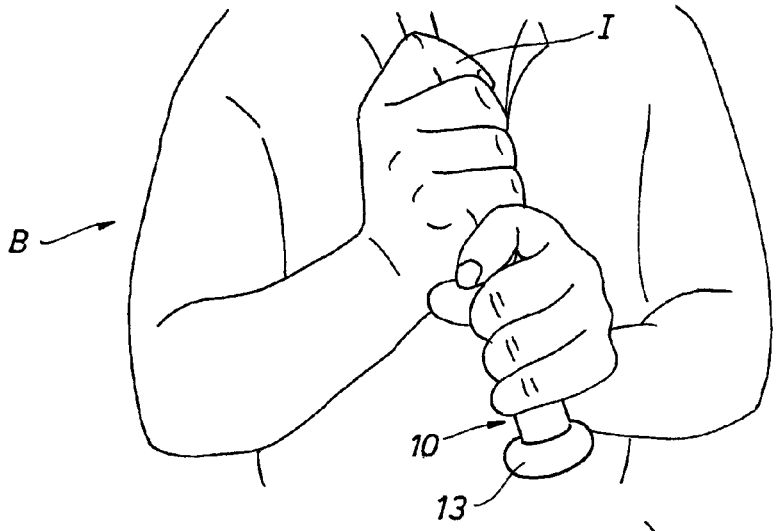
FIG. 9 is an isometric view showing the handle of the training aid of the present invention being gripped by a user.
Figure 10:
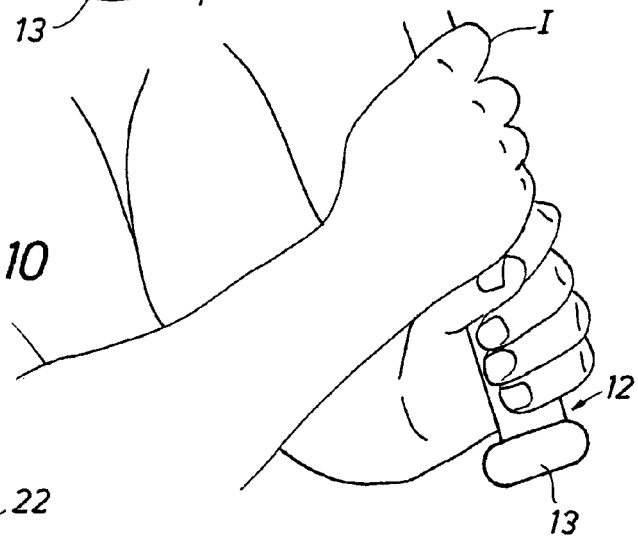
FIG. 10 is another view similar to FIG. 9 showing further detail of the grip of the user on the training aid of the present invention.
Figure 11:
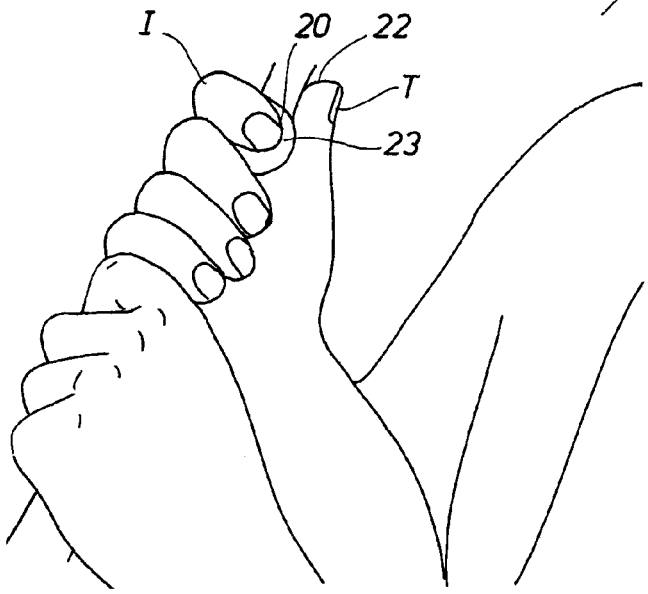
FIG. 11 is another view similar to FIGS. 9 and 10 showing another view of the grip of the user on the training aid of the present invention.

Referring now to FIGS. 9-11 there is shown a user B gripping the batting aid 10 of the present invention. As can be seen, particularly with reference to FIG. 11 index finger I has been received in formation 20 and thumb T received in formation a ridge or trigger formation 23 of gripping portion 18 be gripped between index finger I and thumb T. In effect, once index finger I is received in formation 20 and thumb T is received in formation 22, the ridge or trigger 23 will be compressed between index finger I and thumb T when the hand is tightened around the grip portion 18 and handle portion 12. Although as shown in FIGS. 9-11, the user/hitter is right handed and the batting aid 10 heretofore described is for a right-handed hitter, it will be understood that a batting aid for use with a left-handed hitter is simply a mirror image of the batting aid 10 shown in FIGS. 1-8 heretofore described.

Figure 12:
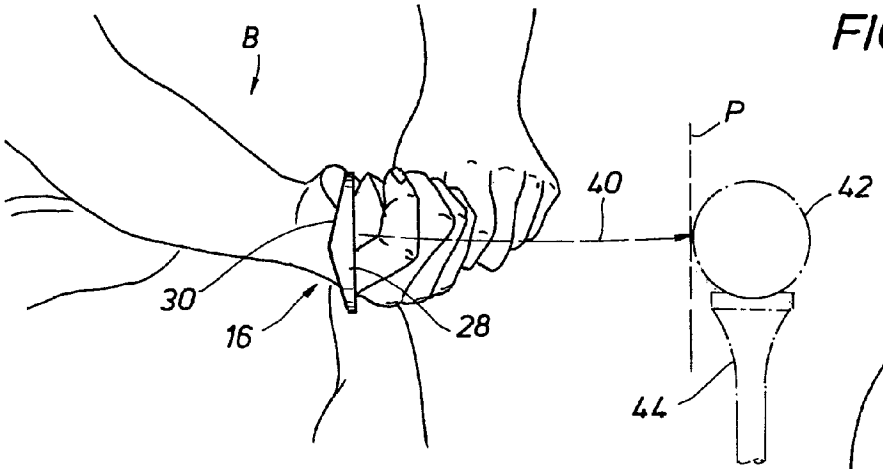
FIGS. 12 and 13 are isometric views showing the use of the training aid of the present invention for striking a practice ball.
Figure 13:
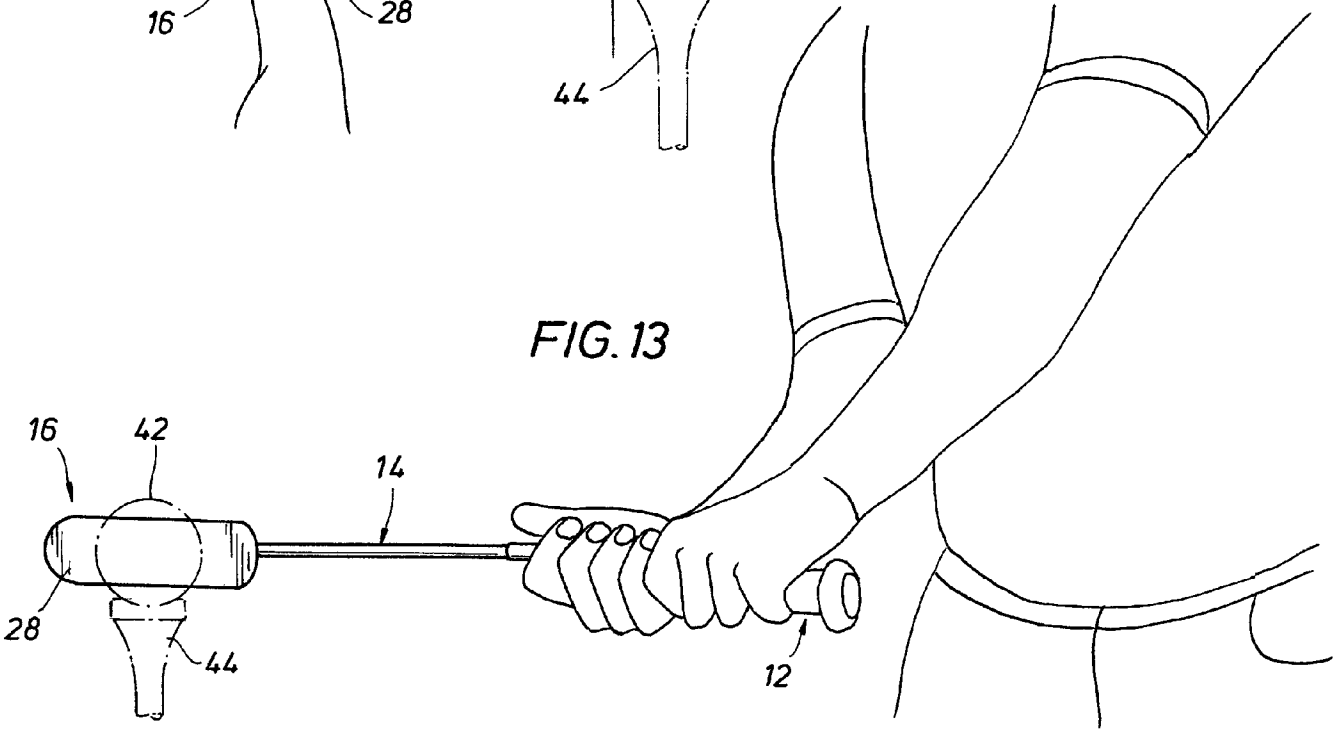

FIGS. 12 and 13 show a right-hand hitter B coming through a swing with the hands properly positioned and the practice ball 42 being properly addressed. In this regard, note that in FIG. 12 the front surface 28 of front side 27 of the blade portion 16 is almost perpendicular to an axis 40 running midway through ball 42 perched on a tee 44. This is also shown in front elevation in FIG. 13. Note with respect particularly to FIG. 12 that as the batter comes through the swing and if the hands are maintained in the proper alignment as shown in FIGS. 12 and 13 through the swing, the surface 28 will strike the ball 42 in such a manner that at the point of impact the surface 28 will lie in a plane P tangential to the surface of the ball 42 which as shown in FIG. 12, will be almost perpendicular to axis 40. Continued forward motion of the swing once the ball 42 is struck in the fashion shown in FIGS. 12 and 13 will force the ball to travel essentially in a straight line along axis 40 providing a "line drive." However, as a practical matter as the batter B continues to swing through the point of impact, the natural motion of the body of the batter B will impart a slight upward arc to the ball 42 sufficient to give the ball an upwardly angled trajectory which, if the ball is struck properly and with sufficient force, will result in a longer distance travel of the ball 42 before it strikes the ground than would be the case if the ball continued to follow the path 40 until it struck the ground. In other words, the slight upward trajectory can produce proper hand path. When the practice ball 42 is struck properly, as depicted, particularly in FIG. 13, the elbow will remain inside close to the body during the swing. In effect, repeated use of the training aid of the present invention also teaches the body of the user to be in proper position, i.e., as the batter moves through the swing and the hands are properly positioned such that the planar or flat surface of the head portion strikes the ball in the proper manner, the motion of the body of the user during the swing will also be proper. As noted above, the neck portion of the handle having a shorter run proximate the handle and a longer run proximate the head is important to keep the elbow in close to the body. This angled formation is also important as it forces the hands of the user in front of the head portion, which is important in the striking of the baseball in the proper fashion. In this way, the angled shank ensures that the wrists or hands of the user are not rolling through the swing.

Figures 14, 15, 16:
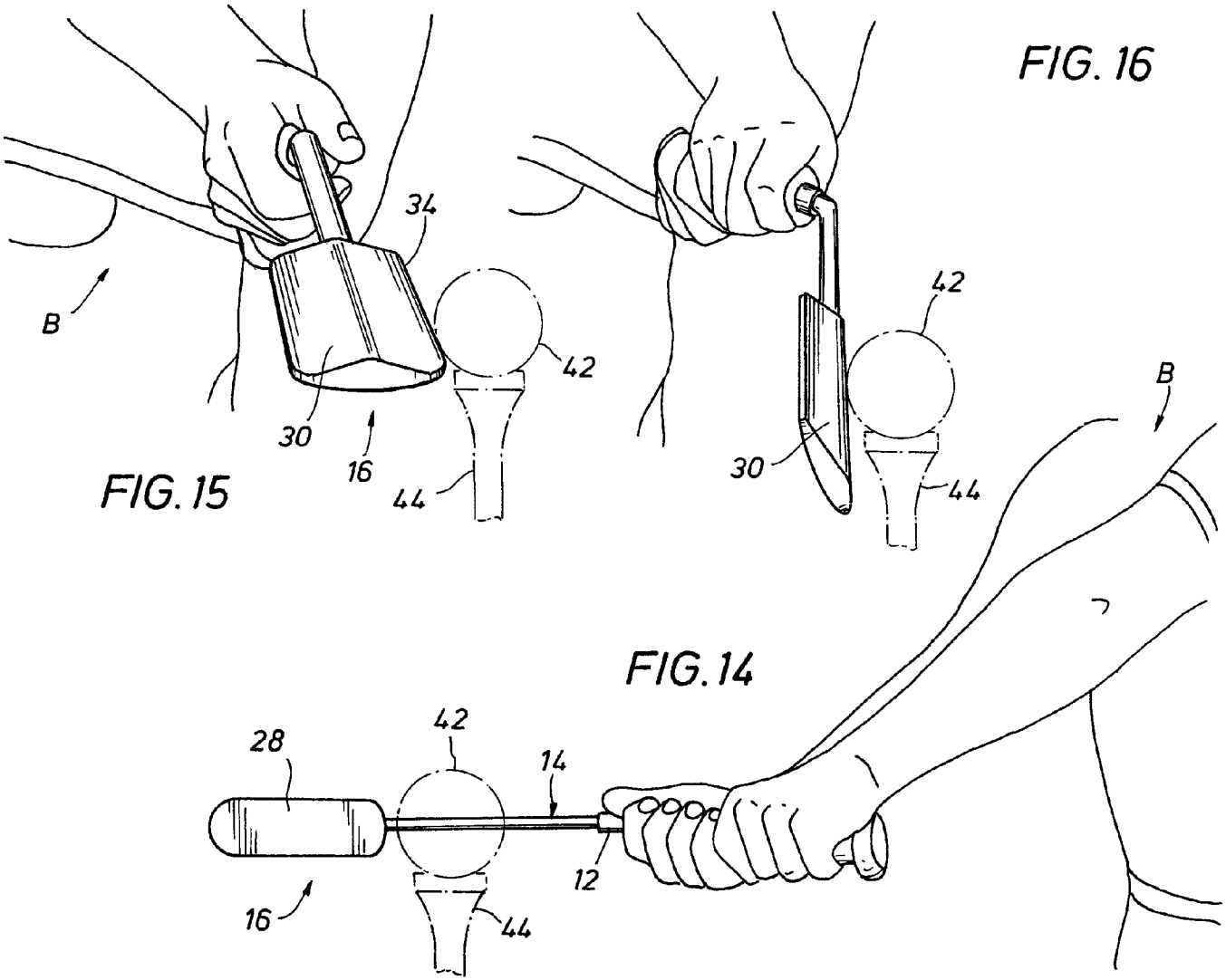
FIGS. 14, 15 and 16 are views similar to FIGS. 12 and 13 but showing an improper grip of the training aid of the present invention with respect to a training ball.

FIGS. 14, 15 and 16 show instances where the swing of the batter B is improper resulting in the ball 42 being struck in an improper manner. With respect first to FIG. 14, it can be seen that at the point of impact the ball 42 is contacted by the shank 14 of the batting aid 12. Contact between the ball 42 and the shank 14 of the batting aid 12 as shown in FIG. 14 occurs when the user or hitter is "casting out," "reaching out," or "swaying" to make contact with the ball 42. Thus, the batting aid 10 in addition to teaching the batter or user the desired positions of the hands as the user comes through the swing, also aids in teaching the batter to keep the elbow in close to the body of batter B, i.e., to not "cast out."

With respect to FIG. 15, this shows the batter's hands in an improper position at the point of impact between the batting aid 10 and the ball 42. In this position, the batter's hands have "rolled over" such that the edge 34 of the blade 16 is striking the ball 42.

In FIG. 16, the hands of the batter have basically completely rolled over in a direction opposite to that depicted in FIG. 15 to the point where the second, contoured surface 30 is contacting the ball 42.

FIGS. 17-21 show another embodiment 10A of the present invention wherein the handle portion 50 has a grip portion 52, forming a slight concave surface 54 for receiving the index finger of the user. In other words, unlike the embodiments described above wherein the gripping portion has a receiving formation for both the thumb and the index finger, the embodiment in FIGS. 17-21 has only a receiving formation for the index finger of the user. Rear portion 52 shown in FIGS. 17-21 is basically comprised of a trigger portion 56 which protrudes laterally outwardly from handle 50, trigger 56 acting in conjunction with handle portion 50 to permit the training aid 10A to be grasped in the appropriate manner. This is particularly true when the cross-sectional configuration of handle portion 50 is substantially like that shown in FIG. 7, i.e., oval or racetrack shaped when viewed in transverse cross-section. It will also be appreciated that while in some embodiments as discussed above, there is a receiving formation for the thumb of the user, such is not necessary. In effect using the embodiment of FIGS. 17-21, with the index finger positioned against trigger 56, and particularly in the case when the handle has the cross-sectional configuration shown in FIG. 7, the handle portion 50 will be nestled in the channel or cradle created by the fingers and the palm of the hand of the user when closed around the handle.

It will be understood, that when reference is made herein to "receiving formation" or concave surface, such a formation need only have sufficient depth or shape to nestle the index finger of the user against the trigger of the grip portion. Indeed, a receiving formation in the context of having any particular depth is not necessarily needed. Thus, while such a receiving formation, indentation, or the like is preferred to help position the index finger on the handle portion of the batting or training aid, it will be understood that the cross-sectional configuration of the handle portion 50 could be essentially uniform throughout its extent, the trigger portion 56 extending sufficiently laterally outward therefrom so as to allow the index finger of the user to be positioned on the handle portion and be prevented from any substantial axial movement.

In FIG. 20 there is shown an embodiment wherein a cross-sectional configuration of the handle portion 50 would be substantially that as shown in FIG. 7 whereas in FIG. 21 the cross-sectional configuration of the handle portion 50 would be substantially circular.

Again with respect to the cross-sectional configuration of the handle portion, regardless of the configuration of the gripping portion, it is preferred that the handle portion, when viewed in transverse cross-section, has a long axis and a short axis, the long axis generally extending along an imaginary plane indicated as X (shown in FIG. 7), passing axially of the handle portion, the short axis extending along an imaginary plane indicated as Y extending transversely through the handle portion, e.g., substantially perpendicular to the long axis. This helps to orient the hands of the user in the proper position on the handle portion in relation to the head. As shown in FIG. 7 while the opposite sides 100 and 102 of the handle formation shown in FIG. 7 are substantially parallel as opposed to surfaces of an arc, it will be understood that the cross-sectional configuration could be substantially oval. Thus, the term oval as used herein is intended to include not only an oval shape per se but a shape, as shown in FIG. 7 wherein there is a long axis X and a short axis Y. Indeed, in one embodiment parallel, straight sides 100 and 102 could extend for substantially the full length of the long axis X, there being slightly rounded radiused ends 104 and 106 connecting parallel sides 100 and 102. It will also be appreciated that the handle portion in cross-sectional configuration could be ovaloid in the sense that it is somewhat pear-shaped having a dimension of one hemisphere larger than the other hemisphere. In such a configuration, the more bulbous shape would be preferably on the side of the handle portion opposite the planar surface of the head portion. It is to be noted that when the handle portion has a oval, racetrack or similar cross-sectional configuration, preferably it will be oriented with respect to the planar striking surface of a head portion such that an imaginary plane passing through the long axis of the handle portion and perpendicular to an imaginary plane passing through the short axis of the handle portion will intersect an imaginary plane formed by the planar or flat striking surface of the head portion in a line which is perpendicular to the long axis passing through the handle portion.

Wherein in the description of the embodiments above there has been reference to a grip portion in the form of contoured receiving formations, triggers, etc., it will be understood that the batting aid of the present invention need not have such a grip, trigger or the like on the handle portion.

It is a particular feature of the batting aid of the present invention that the combination of the angled neck portion, particularly where the shorter run of the neck portion is substantially coaxial with the axis running lengthwise of the handle and the longer run is at an angle to that axis, in combination with the handle portion having a generally oval, racetrack or similar configuration trains the user to keep the elbow inside toward the body and the hands forward or in front of the head portion at the point of impact of the head portion and the ball. However while somewhat less desirable, a handle portion which is circular in cross-section could also be employed in conjunction with the angled neck portion as described above. While the use of a handle portion with a circular cross-section makes it somewhat more difficult for the user to orient the hands properly with respect to the planar or flat hitting surface of the head portion, with several practice swings the user will quickly adjust the position of the hands on the handle portion so that they are properly positioned. As noted, the use of a handle portion with a generally oval, racetrack or similar configuration is helpful in orienting the hands with respect to the planar striking surface of the head portion.

The handle portion can be of varying lengths to accommodate batters from adolescents to adults. By way of example only a handle can range in length from about five inches to about ten inches, the shorter handles being for smaller adolescents, the longer lengths being for adults, teenagers and the like.

By practicing swinging of the batting aid of the present invention and following the trajectory of the ball as it leaves the tee, the batter's hands arms, particularly the elbow, and torso become accustomed to being positioned to maintain the bat level at least through the point of impact with the ball. As such, the batting aid of the present invention will help in developing muscle memory of the user such that with sufficient practice, the proper hand path will become second nature to the hitter.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A training aid for teaching batters how to swing properly comprising:

a head portion, said head portion having a front striking surface said striking surface being planar such that a plane passing through said surface contacts substantially all elements of said surface, and a back surface;

a neck portion, said neck portion having a longer run and a shorter run, said longer run being at an angle of at least 5° to said shorter run, said head portion being connected to said longer run, an axis passing through said head portion being substantially coaxial with said longer run of said neck portion; and a handle portion, said handle portion being connected to said shorter run, said front striking surface facing toward said handle portion, said handle portion being substantially coaxial with said shorter run of said neck portion.

2. The training aid of claim 1, wherein the angle between said longer run and said shorter run is from about 15° to about 40°.

3. The training aid of claim 2, wherein said angle is about 20° to 35°.

4. The training aid of claim 1, wherein said handle portion has an axially extending long axis and a transversely extending short axis, said long axis being coaxial with an axis of said shorter run.

5. The training aid of claim 4, wherein a first imaginary plane passing through said long axis of said handle and a second imaginary plane defined by said planar front surface of said head portion intersect in an imaginary line which is perpendicular to said long axis of said handle.

6. The training aid of claim 4, wherein said handle portion is generally ovaloid shaped when viewed in transverse cross-section.

7. The training aid of claim 1, wherein said handle portion is circular when viewed in transverse cross-section.

8. The training aid of claim 1, wherein said head portion is generally rectangularly shaped.

9. The training aid of claim 1, wherein said head portion has a partially cylindrical, solid portion forming said back surface.

10. The training aid of claim 1, wherein said handle portion includes a grip portion, said grip portion having a first receiving formation for the index finger of a user and a second receiving formation for the thumb of said user.

11. The training aid of claim 1, wherein said handle portion includes a grip portion, said grip portion comprising an outwardly projecting trigger, said trigger cooperating with said grip portion to form a receiving formation for the finger of a batter, said formation facing in the same direction as said front surface of said head portion.

12. The training aid of claim 1, wherein said head portion, said neck portion and said handle portion are substantially rigid.

13. The training aid of claim 1, wherein said head portion, said neck portion and said handle portions are rigidly connected such that none of said portions can be rotated relative to any other portion.

14. A training aid for teaching batters how to swing properly comprising:

a head portion, said head portion having a front striking surface and a back surface, said striking surface being substantially solid;

a neck portion, said neck portion having a longer run and a shorter run, said longer run being at an angle of at least 5° to said shorter run, said head portion being connected to said longer run, an axis passing through said head portion being substantially coaxial with said longer run of said neck portion; and a handle portion, said handle portion being connected to said shorter run, said handle portion and said shorter run being substantially coaxial.

15. The training aid of claim 14, wherein said head portion, said neck portion and said handle portions are rigidly connected such that none of said portions can be rotated relative to any other portion.

16. A training aid for teaching batters how to swing properly comprising:

a head portion, said head portion having at least one planar, front striking surface having an outer periphery and a back surface, the outer periphery of said striking surface being coplanar with the rest of said striking surface;

a neck portion, said neck portion having a longer run and a shorter run, said longer run being at an angle of at least 5° to said shorter run, an axis passing through said head portion being substantially coaxial with said longer run of said neck portion; and a handle portion, said handle portion being connected to said shorter run, said handle portion and said shorter run being substantially coaxial.

17. The training aid of claim 16, wherein said head portion, said neck portion and said handle portions are rigidly connected such that none of said portions can be rotated relative to any other portion.

* * * * *